US009329546B2

(12) United States Patent
Hazeyama et al.

(10) Patent No.: US 9,329,546 B2
(45) Date of Patent: May 3, 2016

(54) FIXING DEVICE

(71) Applicant: Brother Kogyo Kabushiki Kaisha, Nagoya-shi, Aichi-ken (JP)

(72) Inventors: Tomoaki Hazeyama, Yokkaichi (JP); Naoyuki Iwata, Kagamihara (JP); Yasuhiro Maruyama, Kasugai (JP); Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/667,807

(22) Filed: Mar. 25, 2015

(65) Prior Publication Data

US 2015/0277318 A1 Oct. 1, 2015

(30) Foreign Application Priority Data

Mar. 31, 2014 (JP) ..... 2014-074062

(51) Int. Cl.
*G03G 15/20* (2006.01)

(52) U.S. Cl.
CPC ..... *G03G 15/2085* (2013.01)

(58) Field of Classification Search
CPC ..... G03G 15/2025; G03G 15/2075; G03G 2215/2035
See application file for complete search history.

(56) References Cited

U.S. PATENT DOCUMENTS 6,456,819 B1 * 9/2002 Abe et al. ..... 399/329
2012/0051809 A1 3/2012 Miyauchi

FOREIGN PATENT DOCUMENTS

| | | | |
|---|---|---|---|
| JP | H09-101695 | A | 4/1997 |
| JP | 2003-057978 | A | 2/2003 |
| JP | 2007-057851 | A | 3/2007 |
| JP | 2010-054821 | A | 3/2010 |
| JP | 2012-053105 | A | 3/2012 |

* cited by examiner

*Primary Examiner* — Gregory H Curran
(74) *Attorney, Agent, or Firm* — Banner & Witcoff, Ltd.

(57) ABSTRACT

A fixing device includes an endless belt, a backup roller, and a nip member having a first slide contact surface, a second slide contact surface, and a connecting surface connecting the first and second slide contact surfaces. A curvature radius of the second slide contact surface is greater than that of the backup roller in cross section perpendicular to an axis of the backup roller. The connecting surface is disposed between a first imaginary plane and a second imaginary plane, the first imaginary plane including an edge of the endless belt and extending perpendicularly to the axis of the backup roller, the second imaginary plane including an end of a maximum image area proximate to the edge of the endless belt and extending perpendicularly to the axis of the backup roller.

19 Claims, 10 Drawing Sheets

FIXING DEVICE

CROSS REFERENCE TO RELATED APPLICATION

This application claims priority from Japanese Patent Application No. 2014-074062, filed on Mar. 31, 2014, which is incorporated herein by reference in its entirety.

TECHNICAL FIELD

Aspects of the disclosure relate to a fixing device configured to thermally fix a developer image on a recording sheet.

BACKGROUND

A known fixing device, which is configured to thermally fix a developer image on a recording sheet, includes an endless fixing belt, a nip member disposed inside the fixing belt, and a backup member, e.g., a pressure roller, disposed such that the nip member and the backup member sandwich the fixing belt therebetween. In the fixing device, a lubricant is disposed between the fixing belt and the nip member to increase sliding movement of the fixing belt on the nip member.

SUMMARY

As the lubricant disposed between the nip member and fixing belt is subjected to a fixed pressing force due to the fixing belt sandwiched between the nip member and the backup member, the lubricant may move to an end of the fixing belt and then leak from between the nip member and the fixing belt.

Illustrative aspects of the disclosure provide a fixing device configured to prevent a lubricant from leaking from between a nip member and a fixing belt.

According to an aspect of the disclosure, a fixing device includes an endless belt extending in a first direction and configured to rotate, a nip member extending in the first direction and disposed in contact with the inner surface of the endless belt via a lubricant such that the endless belt is slidable on the nip member, and a backup roller extending in the first direction and configured to rotate about an axis and disposed in contact with an outer surface of the endless belt such that the backup roller and the nip member sandwich the endless belt therebetween and the backup roller and the outer surface of the endless belt form a nip therebetween. The nip member has a first slide contact surface disposed in contact with the inner surface of the endless belt, a second slide contact surface disposed in contact with the inner surface of the endless belt and closer to an edge of the inner surface of the endless belt in the first direction than the first slide contact surface and closer to the axis of the backup roller than the first slide contact surface, and a connecting surface connecting the first slide contact surface and the second slide contact surface. A curvature radius of the second slide contact surface of the nip member is greater than a curvature radius of the backup roller in cross section perpendicular to the axis of the backup roller. The connecting surface of the nip member is disposed between a first imaginary plane and a second imaginary plane, the first imaginary plane including an edge of the endless belt in the first direction and extending perpendicularly to the axis of the backup roller, the second imaginary plane including an end of a maximum image area proximate to the edge of the endless belt in the first direction and extending perpendicularly to the axis of the backup roller.

With this structure, the connecting surface can restrict the lubricant from moving outside of the edge of the endless belt, and the lubricant can be held between the nip member and the endless belt. In cross section perpendicular to the axis of the backup roller, the curvature of the second slide contact surface is smaller than the curvature of the outer surface of the backup roller. This allows the endless belt to contact the second slide contact surface widely, with little possibility that an undesired gap will be formed between the endless belt and the second slide contact surface. Thus, movement of the lubricant from the second slide contact surface to the outside of the edge of the endless belt can be efficiently prevented. The connecting surface is disposed outside of the maximum image area and a step formed by the connecting surface has little effect on a toner image formed on a sheet.

According to another aspect of the disclosure, a fixing device include an endless belt extending in a first direction, a nip member extending in the first direction and disposed in contact with an inner surface of the endless belt via a lubricant such that the endless belt is slidable on the nip member, and a backup member extending in the first direction and disposed in contact with an outer surface of the endless belt such that the backup roller and the nip member sandwich the endless belt therebetween and the backup member and the outer surface of the endless belt form a nip therebetween. The nip member includes a recessed portion recessed in a direction away from the backup member. An end of the recessed portion of the nip member in the first direction is disposed between a first imaginary plane and a second imaginary plane, the first imaginary plane including an edge of the endless belt in the first direction and extending perpendicularly to the axis of the backup member, the second imaginary plane including an end of a maximum image area proximate to the edge of the endless belt in the first direction and extending perpendicularly to the axis of the backup member.

With this structure, the lubricant can be collected in the recessed portion and the lubricant can be restricted from leaking outside of the endless belt in the first direction.

According to still another aspect of the disclosure, a fixing device includes an endless belt extending in a first direction and configured to rotate, a nip member extending in the first direction and disposed in contact with the inner surface of the endless belt via a lubricant such that the endless belt is slidable on the nip member, and a backup roller extending in the first direction and configured to rotate about an axis and disposed in contact with an outer surface of the endless belt such that the backup roller and the nip member sandwich the endless belt therebetween and the backup roller and the outer surface of the endless belt form a nip therebetween. The nip member includes a recessed portion recessed in a direction away from the backup member. A first end of the recessed portion in the first direction is disposed closer to a center of the nip member than a first edge of the endless belt in the first direction, and a second end of the recessed portion in the first direction is disposed closer to the center of the nip member than a second edge of the endless belt in the first direction.

With this structure, the lubricant can be collected in the recessed portion and the lubricant can be restricted from leaking outside of the endless belt in the first direction.

BRIEF DESCRIPTION OF THE DRAWINGS

Reference is made to the following description taken in connection with the accompanying drawings, like reference numerals being used for like corresponding parts in the various drawings.

DETAILED DESCRIPTION

A first embodiment of the disclosure will be described with reference to the following drawings.

In the following description, the expressions "front", "rear", "upper or top", "lower or bottom", "right", and "left" are used to define the various parts when a laser printer 1 is disposed in an orientation in which it is intended to be used.

Figure 1:
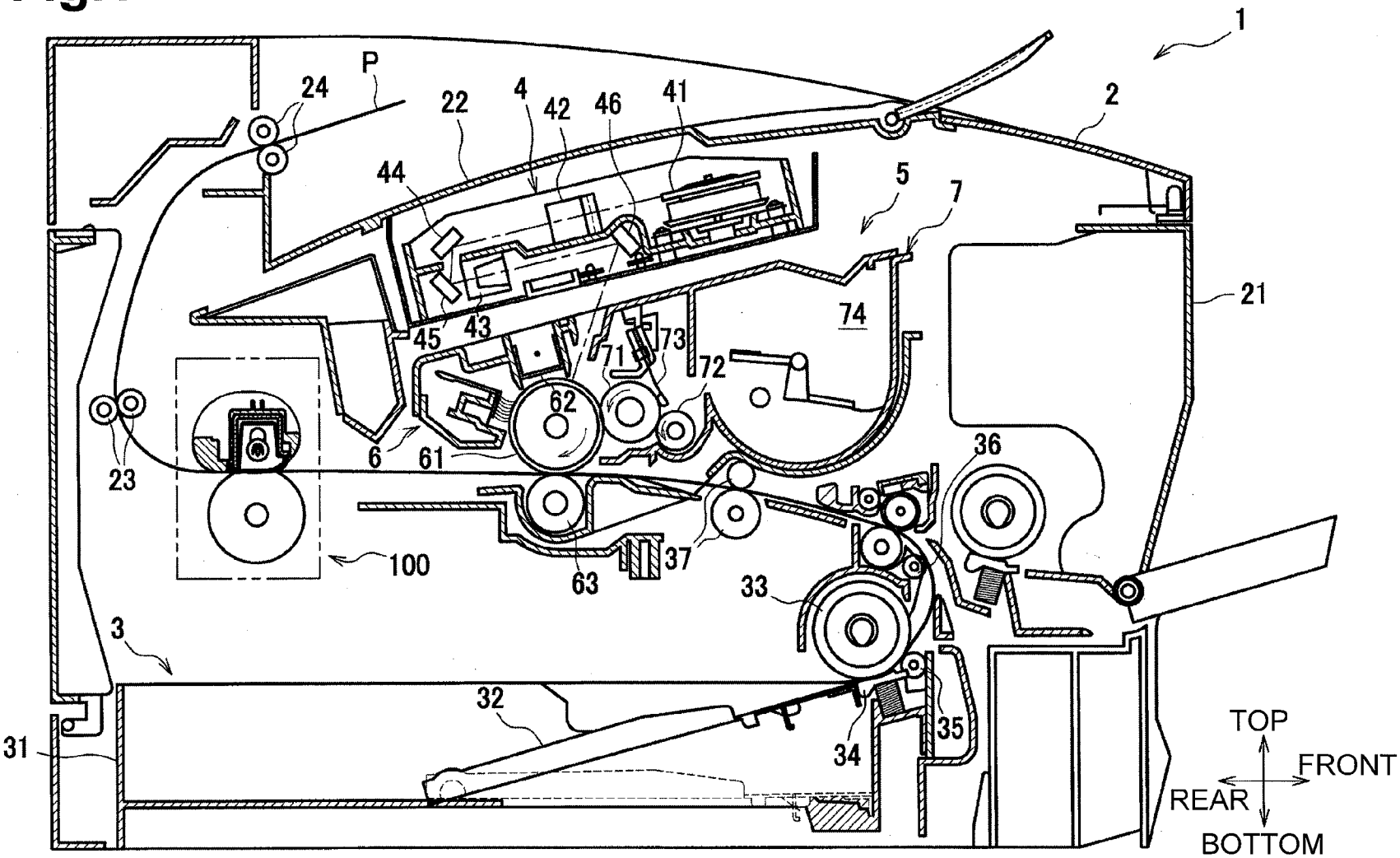
FIG. 1 is a sectional view of a laser printer including a fixing device according to an illustrative embodiment.

As illustrated in FIG. 1, the laser printer 1 includes, in a housing 2, a sheet feed portion 3 configured to feed a recording sheet, e.g., a sheet P, an exposure unit 4, a process cartridge 5 configured to transfer a developer image, e.g., a toner image, onto the sheet P, and a fixing device 100 configured to thermally fix the toner image onto the sheet P.

The sheet feed portion 3 is disposed in a lower portion of the housing 2, and includes a sheet supply tray 31 configured to accommodate a stack of sheets P therein, a sheet pressing plate 32 configured to raise a front portion of a sheet P accommodated in the sheet supply tray 31, a sheet supply roller 33, a sheet supply pad 34, sheet dust removing rollers 35, 36, and registration rollers 37. Sheets P accommodated in the sheet supply tray 31 are raised to the sheet supply roller 33 by the sheet pressing plate 32, and separated one by one by the sheet supply roller 33 and the sheet supply pad 34, and a separated sheet P passes through the sheet dust removing rollers 35, 36 and the registration rollers 37 and is fed toward the process cartridge 5.

The exposure unit 4 is disposed in an upper portion of the housing 2, and includes a laser emitting portion (not illustrated), a polygon mirror 41, lenses 42, 43 and reflective mirrors 44, 45, 46. In the exposure unit 4, laser light (indicated by a dashed line) emitted from the laser light emitting unit is directed to the polygon mirror 41 rotating at high speed. The laser light then passes through or is reflected by the lens 42, the reflective mirrors 44, 45, the lens 43, and the reflective mirror 46 in this order, and scans a surface of the photosensitive drum 61 at high speed.

The process cartridge 5 is disposed below the exposure unit 4, and configured to move in and out of the housing 2 through an opening defined by a front cover 21 provided to the housing 2 at an open position. The process cartridge 5 includes a drum unit 6 and a developing unit 7.

The drum unit 6 includes a photosensitive drum 61, a charger 62, and a transfer roller 63. The developing unit 7 is configured to be attached to and removed from the drum unit 6. The developing unit 7 includes a developing roller 71, a supply roller 72, a layer thickness regulating blade 73, and a toner storing portion 74 configured to store developer, e.g., toner, therein.

In the process cartridge 5, the surface of the photosensitive drum 61 is uniformly charged by the charger 62 and exposed to the laser light emitted from the exposure unit 4 and scanning at high speed, and a latent static image based on the image data is formed on the surface of the photosensitive drum 61. Toner stored in the toner storing portion 74 is supplied to the developing roller 71 via the supply roller 72, passes through between the developing roller 71 and the layer thickness regulating blade 73, and is carried on the surface of the developing roller 71 as a thin layer having a constant thickness.

The toner carried on the developing roller 71 is supplied to the electrostatic latent image formed on the photosensitive drum 61. Thus, the electrostatic latent image becomes visible, and a toner image is carried on the surface of the photosensitive drum 61. When a sheet P passes through between the photosensitive drum 61 and the transfer roller 63, the toner image on the photosensitive drum 61 is transferred onto the sheet P.

The fixing device 100 is disposed behind the process cartridge 5. The toner image transferred onto the sheet P passes through the fixing device 100 such that the toner image is thermally fixed onto the sheet P. The sheet P having the toner image thermally fixed thereon is ejected onto an ejection tray 22 by feed rollers 23, 24.

The structure of the fixing device 100 will be described in detail.

Figure 2:
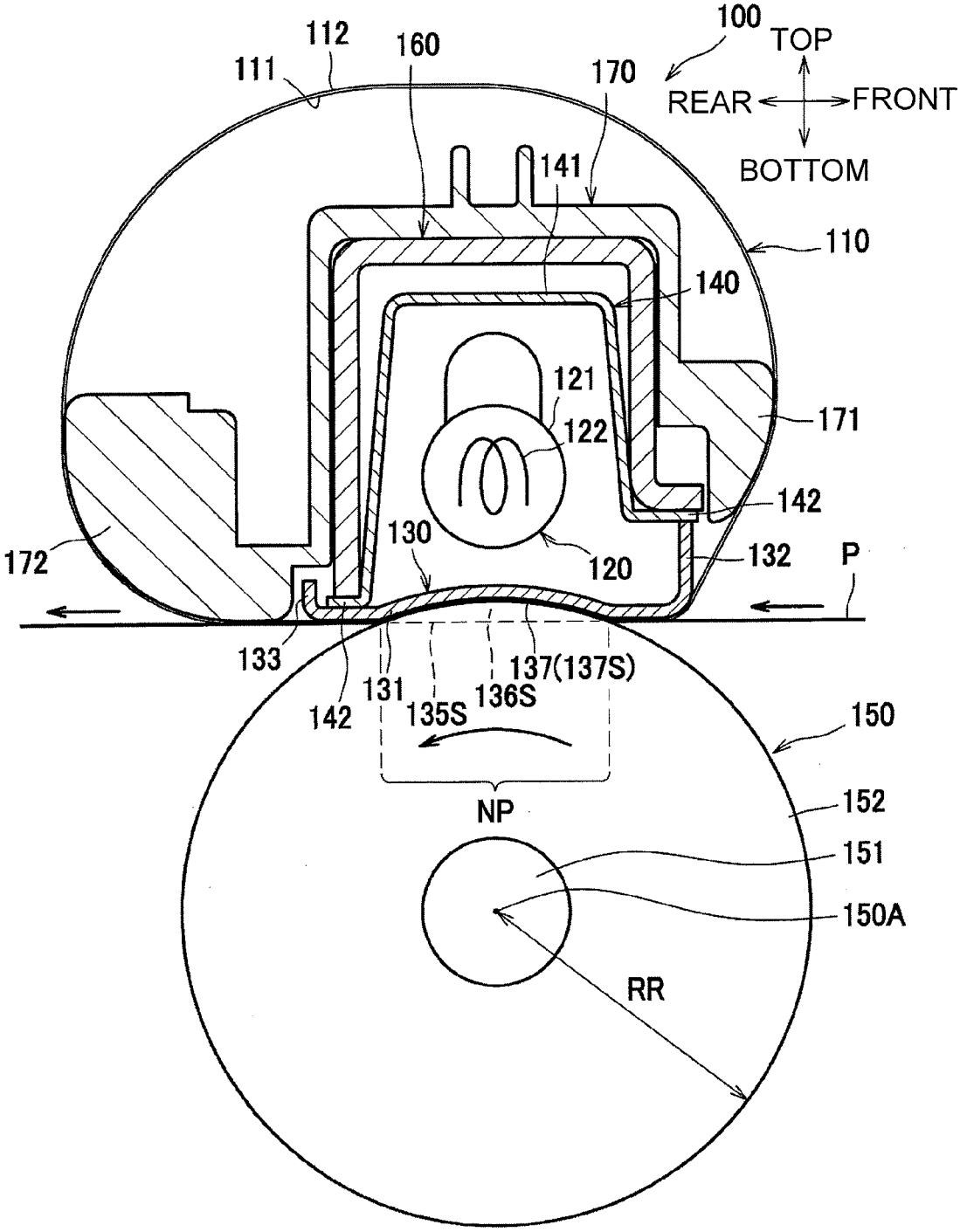
FIG. 2 is a sectional view of the fixing device in a plane perpendicular to a left-right direction.

As illustrated in FIG. 2, the fixing device 100 includes a fixing belt 110 as an example of an endless belt, halogen lamp 120, a nip plate 130 as an example of a nip member, a reflective member 140, a pressure roller (or a backup roller) 150 as an example of a backup member, a stay 160, and a frame member 170.

The fixing belt 110 is an endless belt having heat resistance and flexibility, and has a metal tube made of metal such as stainless steel and a coat layer made of fluorine resin on the surface of the metal tube. The fixing belt 110 is configured to rotate in a clockwise direction in FIG. 2 such that the fixing belt 110 passes through between the nip plate 130 and the pressure roller 150 from the front toward the rear by being guided by inner surface guides 171, 172 provided to the frame member 170. When the fixing belt 110 rotates, its inner surface 111 slidingly contacts the nip plate 130 and its outer surface 112 contacts the pressure roller 150 (or a sheet P).

The fixing belt 110 may have a rubber layer on the surface of the metal tube. The fixing belt 110 may further have a non-metal protective layer, e.g. a fluorine coated layer, on the rubber layer. The fixing belt 110 may include a resin film mainly composed of polyimide. In this case, the fixing belt 110 may have an outer layer made of fluorine resin such as polytetrafluoroethylene.

The halogen lamp 120 is a heater to configured to heat toner transferred onto a sheet P by giving off radiant heat to heat the nip plate 130 and the fixing belt 110. The halogen lamp 120 is disposed at a specified distance from inner surface 111 of the fixing belt 110 inside of the fixing belt 110. The halogen lamp 120 includes a glass tube 121 extending long in the left-right direction and a filament 122 wound in coil and disposed in the glass tube 121, and is configured to become heated from within by the passage of the current electricity through the filament 122.

The nip plate 130 is shaped like a plate receiving the radiant heat from the halogen lamp 120 and disposed inside of the fixing belt 110 such that the nip plate 130 is spaced at a specified distance from the halogen lamp 120 and contacts the inner surface 111 of the fixing belt 110. The nip plate 130 includes a base portion 131, a curved portion 132 extending upward from a front end of the base portion 131, and a bending portion 133 extending upward from a rear end of the base portion 131.

When viewed in the left-right direction (width direction of the fixing belt 110), the base portion 131 has a recessed portion 137 in a central portion on a side facing the pressure roller 110 via the fixing belt 110. The recessed portion 137 is substantially arc-shaped in cross section along an outer surface of the pressure roller 150, and recessed from a lower side on which the pressure roller 150 is disposed to an upper side on which the halogen lamp 120 is disposed (or recessed in a direction away from an axis 150A of the pressure roller 150). The recessed portion 137 constitutes a part of a slide contact surface (or a first slide contact surface 137S) configured to contact the inner surface 111 of the fixing belt 110. The base portion 131 is shaped like a flat plate (with zero curvature) except for the recessed portion 137.

The nip plate 130 is configured to transmit the radiant heat received from the halogen lamp 120 to toner on the sheet P via the fixing belt 110, and thus is made of metal and formed by bending a material, e.g., an aluminum plate and a stainless steel plate, having higher thermal conductivity than the steel stay 160. The nip plate 130 may be coated with fluorine or polyimide resin or covered with an oxide film or plating. The nip plate 130 will be described in detail later.

The reflective member 140 is configured to reflect the radiant heat from the halogen lamp 120 toward the nip plate 130. The reflective member 140 is disposed surrounding the halogen lamp 120 at a specified distance from the halogen lamp 120 inside the fixing belt 110. The reflective member 140 is formed by bending a material, e.g., an aluminum plate, having high infrared and far-infrared reflectance and high thermal conductivity. Specifically, the reflective member 140 includes a reflective portion 141 having a U shape in cross section, and flange portions 142 extending outward in the front-rear direction from respective lower ends of the reflective portion 141. The reflective member 140 may be formed with an aluminum plate polished to a mirror-smooth state to increase heat reflectance.

The pressure roller 150 is disposed below the nip plate 130 such that the pressure roller 150 and the nip plate 130 sandwich the fixing belt 110 therebetween and configured to feed a sheet P between the pressure roller 150 and the fixing belt 110. The pressure roller 150 includes a shaft 151 made of metal, and a roller body 152 disposed around the shaft 151 and having elasticity. The pressure roller 150 and the nip plate 130 sandwich the fixing belt 110 with the roller body 152 partially deformed such that a nip NP is formed between the pressure roller 150 and the fixing belt 110. In the embodiment, one of the pressure roller 150 and the nip plate 130 is urged toward the other one thereof to form the nip NP and the roller body 152 of the pressure roller 150 becomes partially deformed.

The pressure roller 150 is configured to rotate upon receipt of a driving force transmitted from a motor (not illustrated) disposed in the housing 2. The rotation of the pressure roller 150 allows the fixing belt 110 to be rotated due to friction between the pressure roller 150 and the fixing belt 110 (or a sheet P on the fixing belt 110). The sheet P on which a toner image has been transferred is fed to between the pressure roller 150 and the heated fixing belt 110, and thus the toner image is thermally fixed onto the sheet P.

The stay 160 secures stiffness of the nip plate 130, which is subjected to a load from the pressure roller 150, by supporting the nip plate 130 via the flange portions 142 of the reflective member 140. The stay 160 is disposed surrounding the reflective member 140 inside of the fixing belt 110. The stay 160 is substantially U-shaped in cross section along the outer shape of the reflective portion 141 of the reflective member 140. The stay 160 is formed by bending a material, e.g., a steel plate, having relatively high stiffness.

The frame member 170 is configured to support left and right end portions of the halogen lamp 120 and the stay 160, is disposed surrounding the stay 160 inside of the fixing belt 110 and is fixed to the stay 160. The frame member 170 is made of resin having heat resistance and includes inner surface guides 171, 172 for guiding the fixing belt 110 rotating.

The nip plate 130 will be described in detail.

Figure 3:
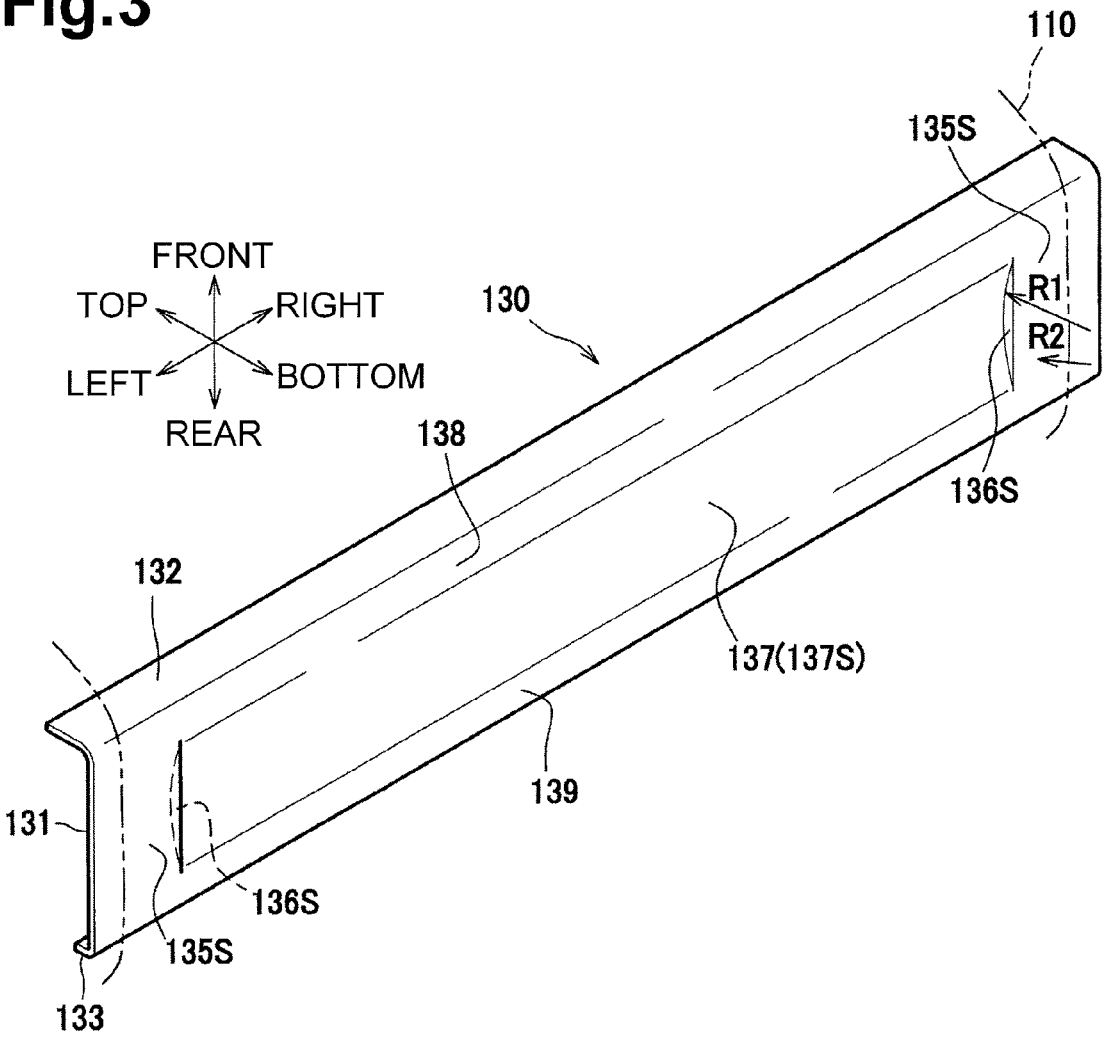
FIG. 3 is a perspective view of a nip plate when viewed from a side on which a fixing belt slides.

As illustrated in FIGS. 2 and 3, the base portion 131 of the nip plate 130 includes second slide contact surfaces 135S. The second slide contact surfaces 135S are disposed proximate to left and right end portions of the first slide contact surface 137S. Each of the second slide contact surfaces 135S is disposed closer to a corresponding one of left and right edges of the fixing belt 110 than the first slide contact surface 137S such that each second slide contact surface 135S contacts a corresponding end portion of the inner surface 111 of the fixing belt 110 rotating. Each second slide contact surface 135S is disposed closer to the axis 150A of the pressure roller 150 than the first slide contact surface 137S. Each second slide contact surface 135S and the first slide contact surface 137S are connected by a corresponding connecting surface 136S extending upward from the second slide contact surface 135S (or extending from the side closer to the axis 150A of the pressure roller 150 to the side farther from the axis 150A thereof).

In this embodiment, each connecting surface 136S is a flat surface perpendicular to the axis 150A of the pressure roller 150 and facing inward in the width direction of the fixing belt 110. In the following description, "the width direction of the fixing belt 110" may be abbreviated as just "the width direction."

The nip plate 130 is formed by bending a metal plate. Each end portion of the nip plate 130 in the width direction has a first bend portion B1 connecting the first slide contact surface 137S and the connecting surface 136S, and a second bend portion B2 connecting the second slide contact surface 135S and the connecting surface 136S (See FIG. 4B).

A portion of the nip plate 130, which extends from the base portion 131 to a part of the bending portion 132 and faces the inner surface 111 of the fixing belt 110, constitutes a slide contact surface. Grease (not illustrated) as an example of a lubricant is disposed between the slide contact surface and the inner surface 111 of the fixing belt 110 to improve sliding movement therebetween (see FIG. 2). The second slide contact surface 135S is an area of the slide contact surface disposed at an end portion of the nip plate 130 and outwardly adjacent to the connecting surface 136S in the width direction.

In this embodiment, the first slide contact surface 137S is curved with substantially a constant curvature (a curvature radius R1) and along the outer surface of the pressure roller 150. The second slide contact surfaces 135S are substantially flat and its curvature radius R2 (=infinity) is greater than a curvature radius PR of the outer surface of the roller body 152 of the pressure roller 150.

In this embodiment, each end of the recessed portion 137 in the width direction (or the connecting surface 136S extending substantially vertically) forms a difference in level between a corresponding second slide contact surface 135S and the first slide contact surface 137S, necessitating a step. Upstream and downstream end portions of the recessed portion 137 in the rotation direction of the fixing belt 110 are smoothly connected to upstream and downstream slide contact areas 138, 139 of the nip plate 130.

Figure 4A:
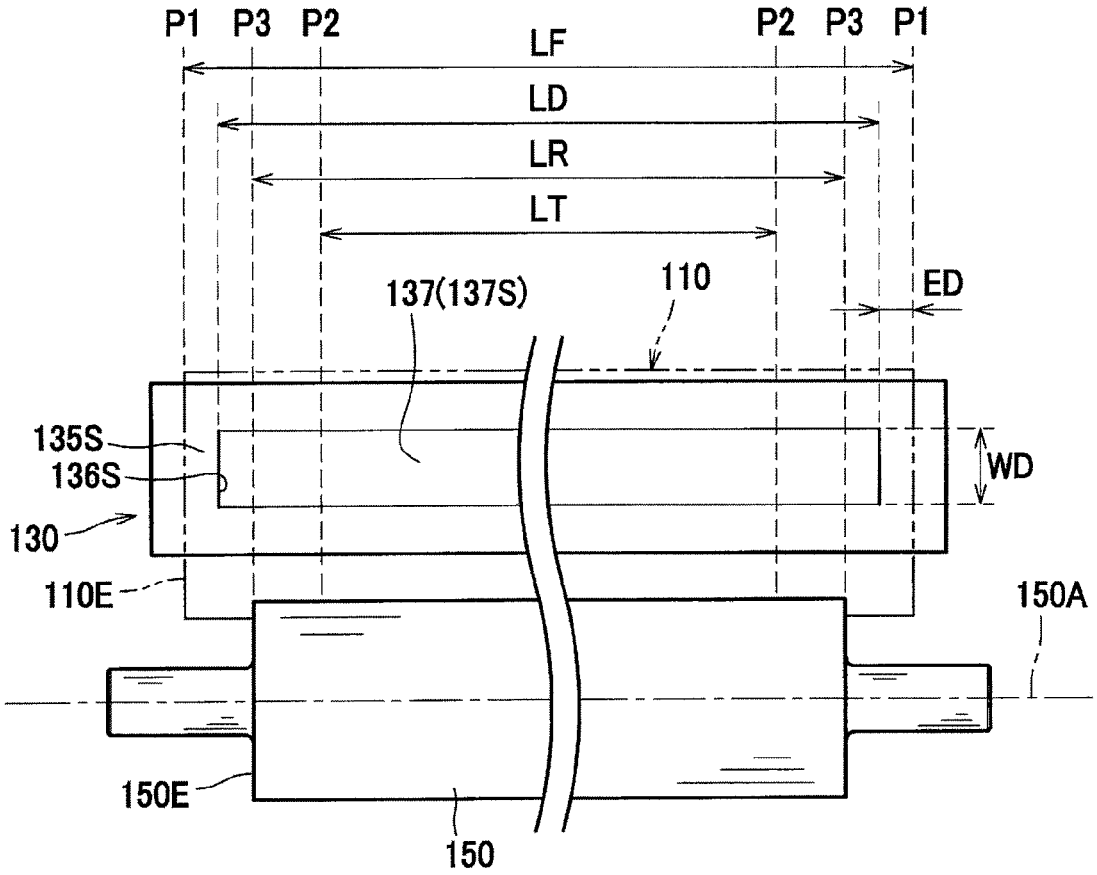
FIG. 4A is a schematic explanatory drawing illustrating a positional relationship between the nip plate and a pressure roller in the fixing device based on a connecting surface of the nip plate.
Figure 4B:
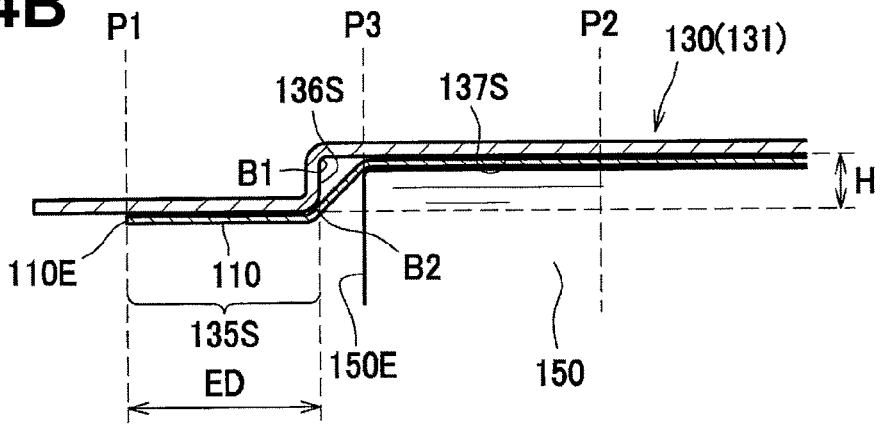
FIG. 4B is a sectional view illustrating a configuration of elements proximate to an end portion of the nip plate including the connecting surface.

The positions of the connecting surfaces 136S in the width direction of the fixing belt 110 will be described in detail with reference to FIGS. 4A and 4B. FIG. 4A illustrates the nip plate 130 viewed from the bottom. FIG. 4B is a sectional view illustrating an end portion of the nip plate 130 including the connecting surface 136S. Note that, in FIG. 4A, the pressure roller 150 is illustrated as being displaced rearward (toward a downstream side in the sheet feed direction) from a position directly below the nip plate 130 for convenience sake.

In FIG. 4A, a plane including the edge 110E of the fixing belt 110 and extending perpendicularly to the axis 150A of the pressure roller 150 is referred to as a first imaginary plane P1, a plane including an end of a maximum image area (a maximum area in which the laser printer 1 is configured to form a toner image) proximate to the edge 110E of the fixing belt 110 in the width direction and extending perpendicularly to the axis 150A of the pressure roller 150 is referred to as a second imaginary plane P2, and a plane including an end of the nip NP disposed proximate to the edge 110E of the fixing belt 110 in the width direction and extending perpendicularly to the axis 150A of the pressure roller 150 is referred to as a third imaginary plane P3.

Further, LF indicates a width of the fixing belt 110, LD indicates a distance between the connecting surfaces 136S (or a length of the recessed portion 137), LR indicates a distance between ends 150E of the roller body 152 (contacting the fixing belt 110) of the pressure roller 150, and LT indicates an image formable area (or the maximum image area).

In this embodiment, elements are structured to establish an inequality relation LF>LD>LR>LT. In short, each connecting surface 136S is disposed between the first imaginary plane P1 and the third imaginary plane P3 or closer to the center than a respective edge 110E of the fixing belt 110 and farther to the center than a respective end 150E of the roller body 152 of the pressure roller 150 contacting the fixing belt 110.

With this positional relationship, as exaggeratedly illustrated in FIG. 4B, the connecting surface 136S, the first slide contact surface 137S and an end portion of the fixing belt 110 in the width direction define a gap. Even if the grease disposed between the nip plate 130 and the fixing belt 110, which is pressed and driven by the pressure roller 150, is forced out of the end 150E of the pressure roller 150 in the width direction, the grease is collected in the gap.

A dimension ED of the second slide contact surface 135S in the direction of the axis 150A of the pressure roller 150 is 1.0 mm to 5.0 mm. A dimension WD of the connecting surface 136 at the nip NP in the moving direction of the fixing belt 110 is 5.0 mm to 15 mm. A dimension (or height) H of the connecting surface 136S in a direction perpendicular to both the axis 150A of the pressure roller 150 and the moving direction of the fixing belt 110 at the nip NP is 0.1 mm to 1.0 mm.

Figure 5:
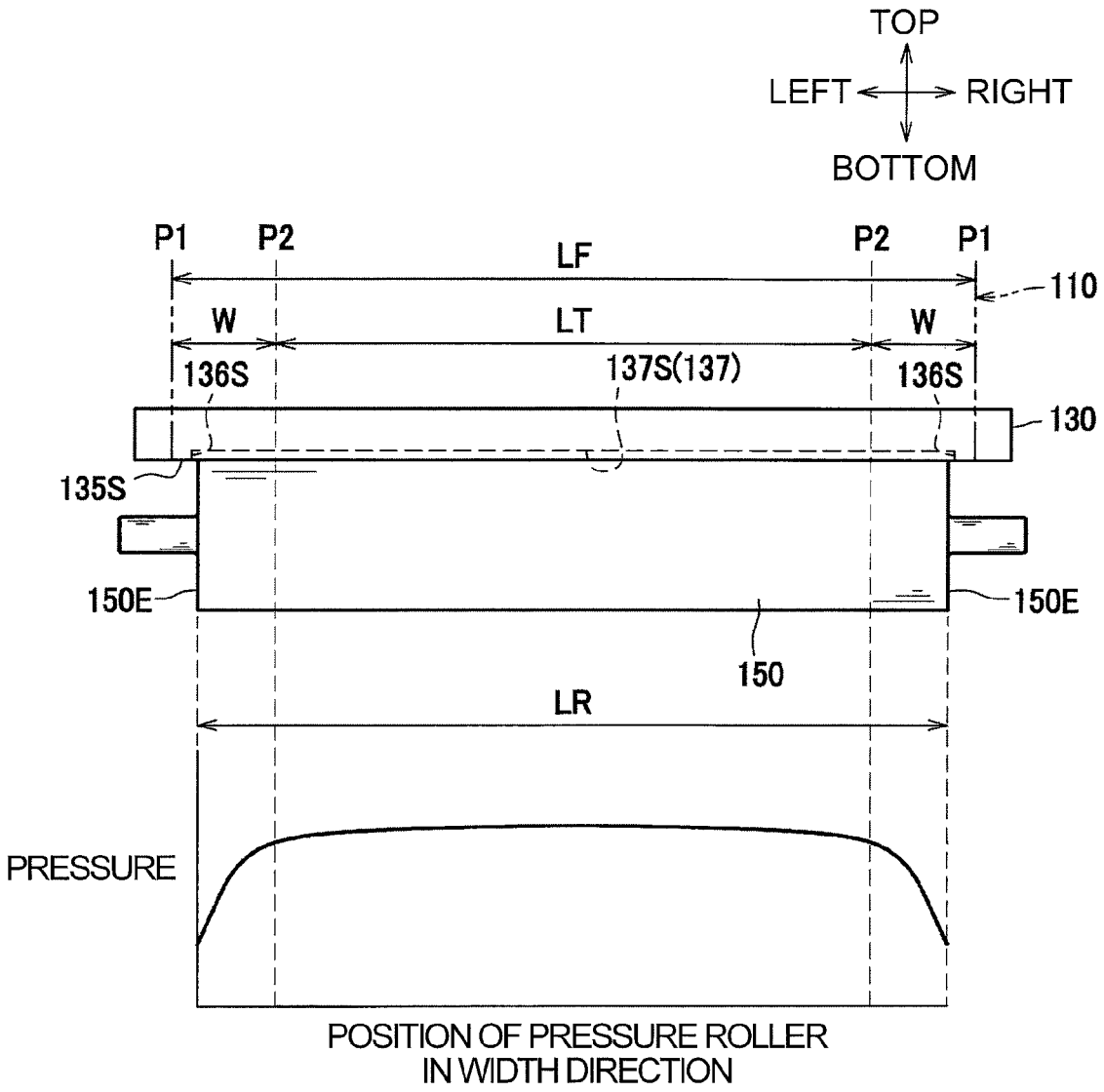
FIG. 5 illustrates a relationship between a configuration of the nip plate and the pressure roller and a pressure distribution chart of the pressure roller in a width direction thereof.

In this embodiment, as illustrated in FIG. 5, the pressing force of the pressure roller 150 is lower at the left and right end portions thereof than at a central portion thereof. Thus, grease is likely to leak outward in the width direction of the fixing belt 110. However, as the fixing belt 110 is pressed into the recessed portion 137 (toward the halogen lamp 120) at the ends 150E of the pressure roller 150, each end portion of the fixing belt 110 not contacting the pressure roller 150 is brought into intimate contact with a ridge (second bend portion B2) forming a border between the connecting surface 136S and the second slide contact surface 135S. Due to the step formed by the connecting surface 136S, grease can be prevented from leaking from the edge 110E of the fixing belt 110 efficiently.

The connecting surface 136S is disposed outside of the image formable area LT (the maximum image area) and the step formed by the connecting surface 136S has little effect on a toner image formed on the sheet P.

In this embodiment, the recessed portion 137 is substantially arc-shaped in cross section, and its tubular curved portion (or the first slide contact surface 137S) is shaped along an outer surface of the roller body 152 of the pressure roller 150 (see FIG. 2). Thus, in comparison with a case where the pressing roller 150 is pressed against the fixing belt 110 contacting a flat nip plate, the fixing belt 110 is widely sandwiched between the pressure roller 150 and the nip plate 130 including the recessed portion 137, and a wider nip is formed between the fixing belt 110 and the pressure roller 150. This improves heating efficiency and facilitates smooth and reliable rotation of the fixing belt 110.

The curvature radius of the recessed portion 137 may be greater or smaller than that of the outer surface of the roller body 152 of the pressure roller 150 as long as the nip NP can be maintained appropriately by deformation of the pressure roller 150. The nip NP may extend to the upstream and downstream slide contact areas 138, 139 of the nip plate 130 outside of the recessed portion 137 thereof in the moving direction of the fixing belt 110.

Figure 6A:
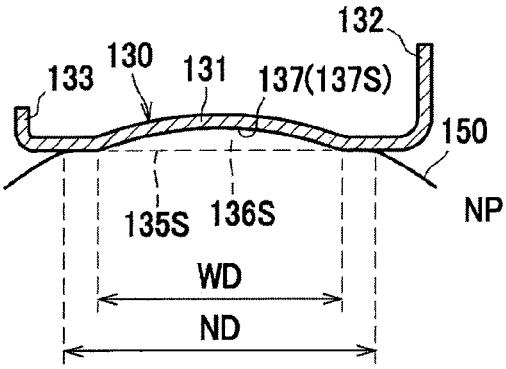
FIGS. 6A to 6D illustrate examples of a recessed portion and a nip formation area in the fixing device according to the first embodiment.
Figure 6B:
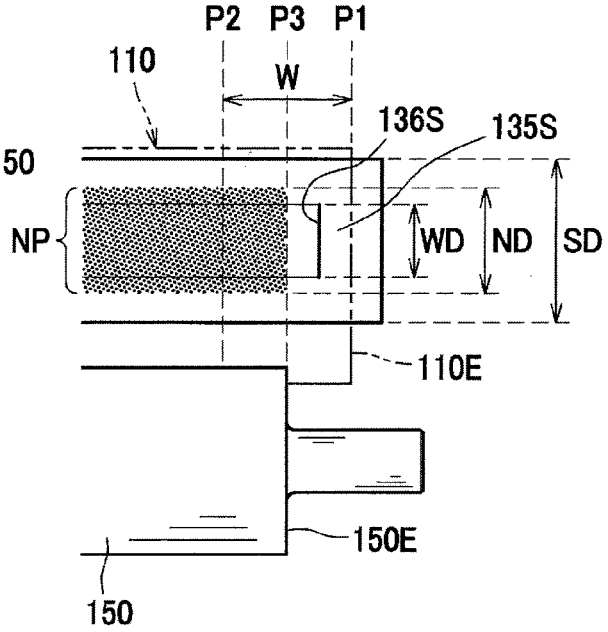

As illustrated in FIGS. 6A and 6B, the connecting surface 136S of the nip plate 130 may be structured such that its dimension WD in the moving direction of the fixing belt 110 is smaller than a dimension ND of the nip NP in the moving direction of the fixing belt 110, which is located in an area W disposed between the first imaginary plane P1 and the second imaginary plane P2.

In FIG. 6B, a dimension SD of the second slide contact surface 135S in the moving direction of the fixing belt 110 is greater than the dimension WD of the connecting surface 136S in the moving direction of the fixing belt 110. The dimension SD is 5.0 mm to 20 mm.

Figure 6C:
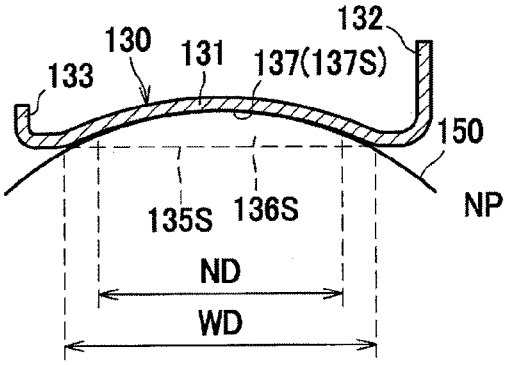
Figure 6D:
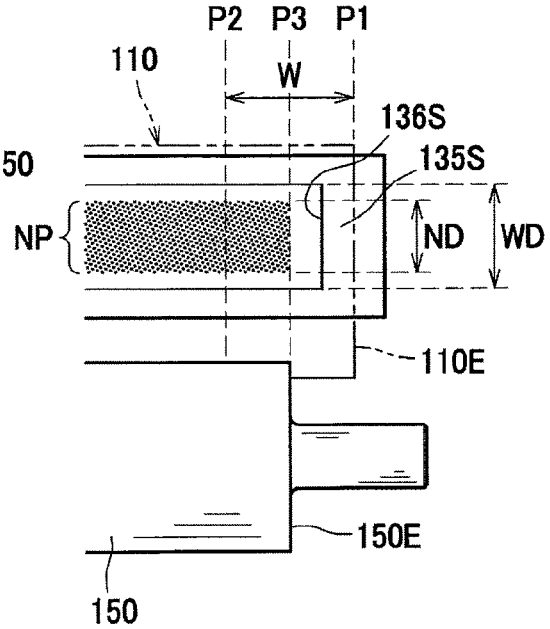

As illustrated in FIGS. 6C and 6D, the connecting surface 136S of the nip plate 130 may be structured such that its dimension WD in the moving direction of the fixing belt 110 is greater than the dimension ND of the nip NP in the moving direction of the fixing belt 110, which is located in the area W disposed between the first imaginary plane P1 and the second imaginary plane P2.

Figure 7A:
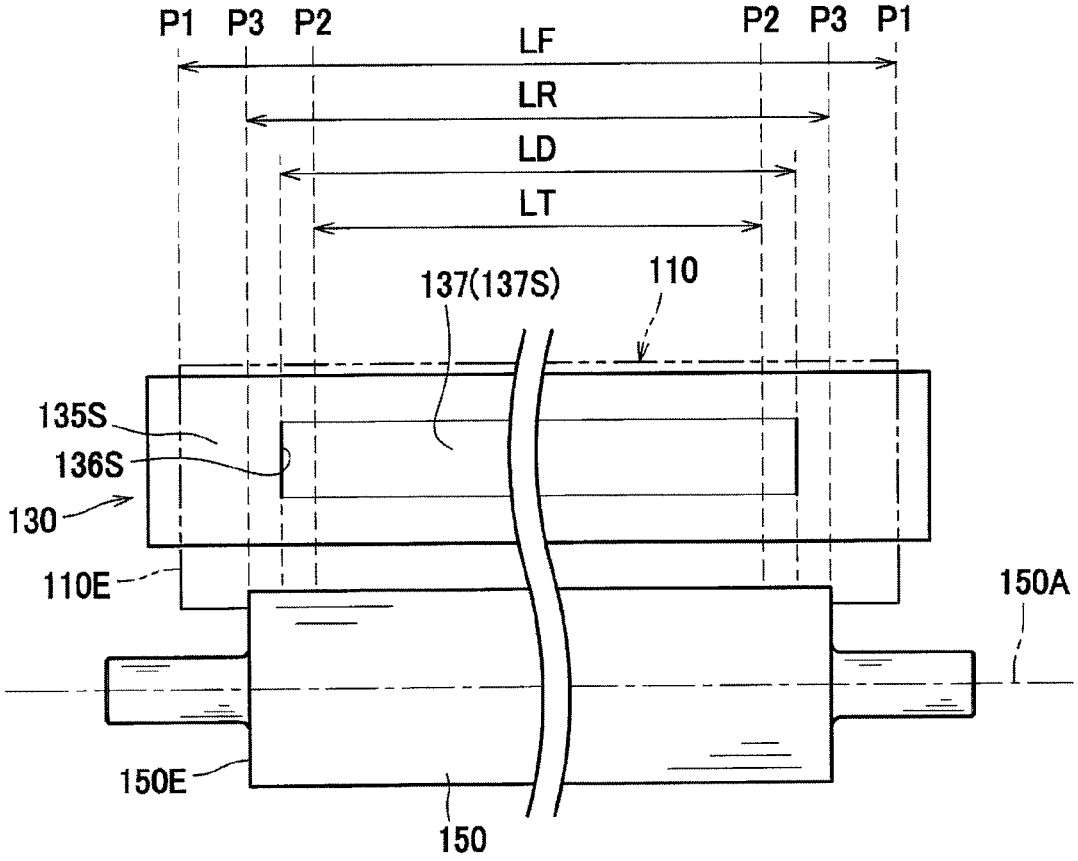
FIG. 7A is a schematic explanatory drawing illustrating a positional relationship between a nip plate and a pressure roller in a fixing device based on a connecting surface of the nip plate according to a second embodiment.

A second embodiment of the disclosure will be described with reference to FIGS. 7 and 8. It is noted that, in the following description, elements similar to or identical with those illustrated and described in the first embodiment are designated by similar numerals, and thus the description thereof can be omitted for the sake of brevity. FIG. 7A illustrates the nip plate viewed from the bottom and FIG. 7B is a sectional view illustrating an end portion of the nip plate 130 including the connecting surface 136S in the width direction.

In the second embodiment, as illustrated in FIG. 7A, elements are structured to establish an inequality relation LF>LR>LD>LT. In short, each connecting surface 136S is disposed between the second imaginary plane P2 and the third imaginary plane P3 or closer to the center than an end 150E of the roller body 152 of the pressure roller 150 contacting the fixing belt 110 and outside of the image formable area LT. In other words, each end portion of the fixing belt 110 contacting the second slide contact surfaces 135S is disposed overlapping a corresponding end portion of the pressure roller 150 contacting the fixing belt 110.

Figure 7B:
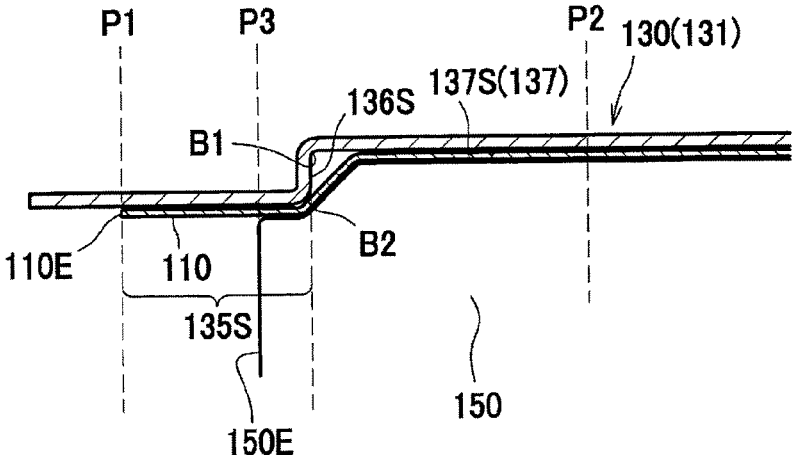
FIG. 7B is a sectional view illustrating a configuration of elements proximate to an end portion of the nip plate including the connecting surface according to the second embodiment.

With this positional relationship, as exaggeratedly illustrated in FIG. 7B, each end portion of the pressure roller 150 and the second slide contact surface 135S of the nip plate 130 surely and strongly sandwich the fixing belt 110. Thus, grease accumulating in the recessed portion 137 can be efficiently prevented from leaking outside of the fixing belt 110 over the step formed by the connecting surface 136S (at the second bend portion B2). A central portion of the pressure roller 150 in the width direction becomes deformed such that the fixing belt 110 is brought in contact with the first slide contact surface 137S.

Figure 8A:
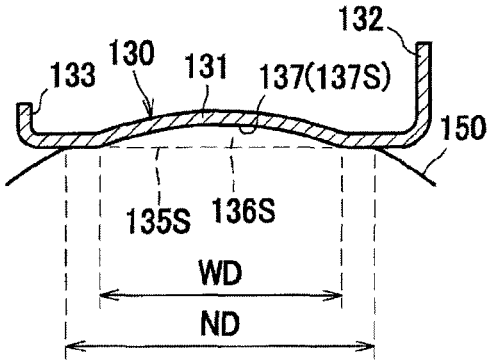
FIGS. 8A to 8D illustrate examples of a recessed portion and a nip formation area in the fixing device according to the second embodiment.
Figure 8B:
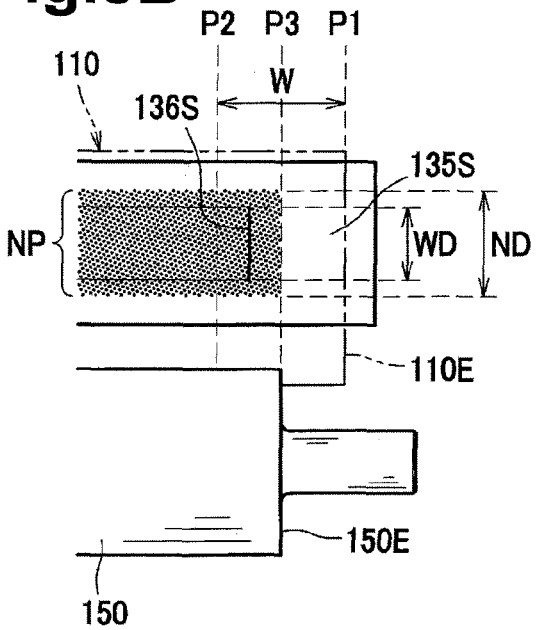

As illustrated in FIGS. 8A and 8B, the connecting surface 136S of the nip plate 130 may be structured such that its dimension WD in the moving direction of the fixing belt 110 is smaller than the dimension ND of the nip NP in the moving direction of the fixing belt 110, which is located in the area W disposed between the first imaginary plane P1 and the second imaginary plane P2.

Figure 8C:
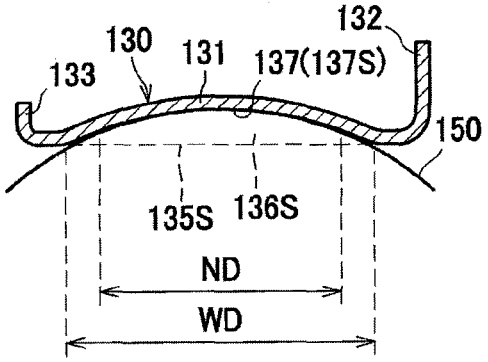
Figure 8D:
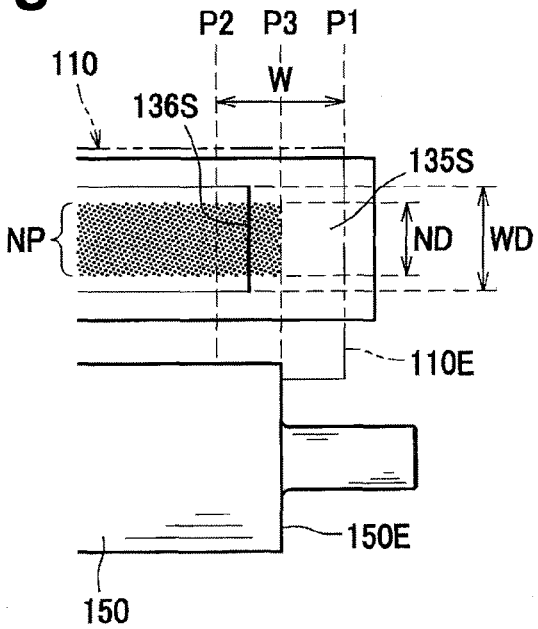

As illustrated in FIGS. 8C and 8D, the connecting surface 136S of the nip plate 130 may be structured such that its dimension WD in the moving direction of the fixing belt 110 is greater than the dimension ND of the nip NP in the moving direction of the fixing belt 110, which is located in the area W disposed between the first imaginary plane P1 and the second imaginary plane P2.

The first and second embodiments illustrate exemplary arrangements of the connecting surface 136S of the nip plate 130 of the fixing device. In the first and second embodiments, each connecting surface 136S is disposed closer to the center than the edge 110E of the fixing belt 110 (within the area LF) and outside of the image formable area LT. In other words, each connecting surface 136S forming a step is disposed between the first imaginary plane P1 and the second imaginary plane P2 (or within the area W). The area W corresponds to an end portion of the pressure roller 150 illustrated in FIG. 5 in the width direction in which pressing force is relatively low. As the connecting surface 136S is disposed within the area W, grease leakage can be prevented. It is noted that FIG. 5 illustrates an arrangement of the connecting surfaces 136S at ends of the recessed portion 137 indicated by a dashed line in the first embodiment.

According to the first and second embodiments, the connecting surfaces 136S are disposed closer to the center than the respective edges 110E of the fixing belt 110 and proximate to the respective end portions of the pressure roller 150 in the width direction in which pressing force is relatively low. As the connecting surfaces 136S restrict grease from moving from the respective second slide contact surfaces 135S toward the respective edges 110E of the fixing belt 110, grease is held between the nip plate 130 and the fixing belt 110. In cross section perpendicular to the width direction of the fixing belt 110, the curvature (=zero) of the second slide contact surface 135S is smaller than the curvature of the outer surface of the roller body 152 of the pressure roller 150. This allows the fixing belt 110 to contact the second slide contact surface 135S widely, with little possibility that an undesired gap will be formed between the fixing belt 110 and the second slide contact surface 135S. Thus, movement of grease from the second slide contact surface 135S to the edge 110E of the fixing belt 110 in the width direction can be efficiently prevented.

Grease could be prevented from leaking outward from the fixing belt in the width direction by providing walls or steps outside of the edges of the fixing belt in the width direction. In this case, however, grease leaked outward from the fixing belt is not collected and if the leaked grease becomes increased in quantity, it may leak outside of the nip plate in the end.

In the first and second embodiments, as the connecting surfaces 136S are disposed closer to the center than the respective edges 110E of the fixing belt 110, grease can be reliably held within the edges 110E of the fixing belt 110 and degradation in sliding performance of the fixing belt 110 can be reduced effectively.

In a structure to prevent grease leakage at the positions outside of the edges of the fixing belt in the width direction, grease leaked outside of an edge 110E of the fixing belt 110 may reach an outer surface of the fixing belt, which may soil sheets P. In the above embodiments, however, walls or steps are not disposed outside of the fixing belt 110 in the width direction. In other words, the connecting surfaces 136S are disposed between the edges 110E of the fixing belt 110 or within the fixing belt 110 in the width direction. With this structure, if grease leaks outside beyond the edges 110E of the fixing belt 110, the risk of the leaked grease reaching the outer surface 112 of the fixing belt 110 is very small.

Figure 9A:
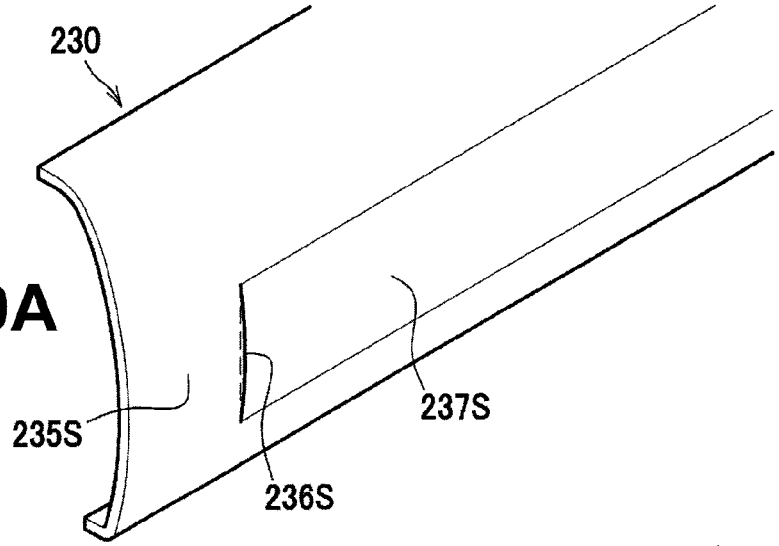
FIGS. 9A to 9C illustrate modifications in shape of a nip plate.
Figure 9B:
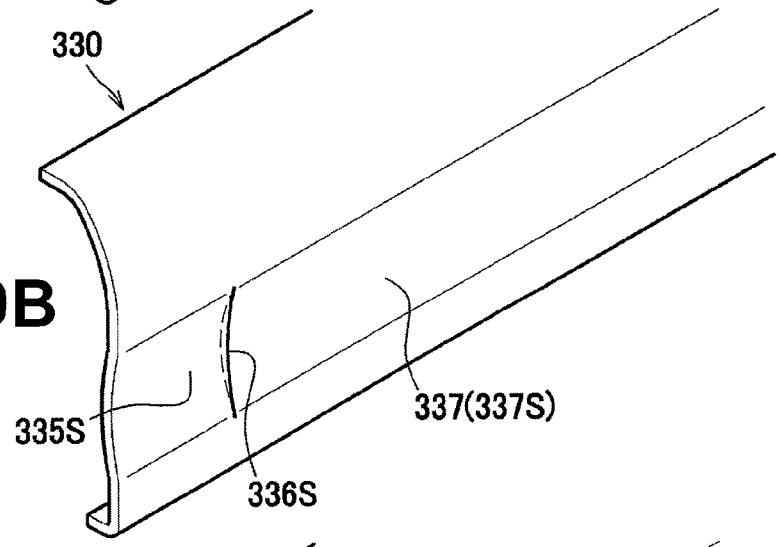
Figure 9C:
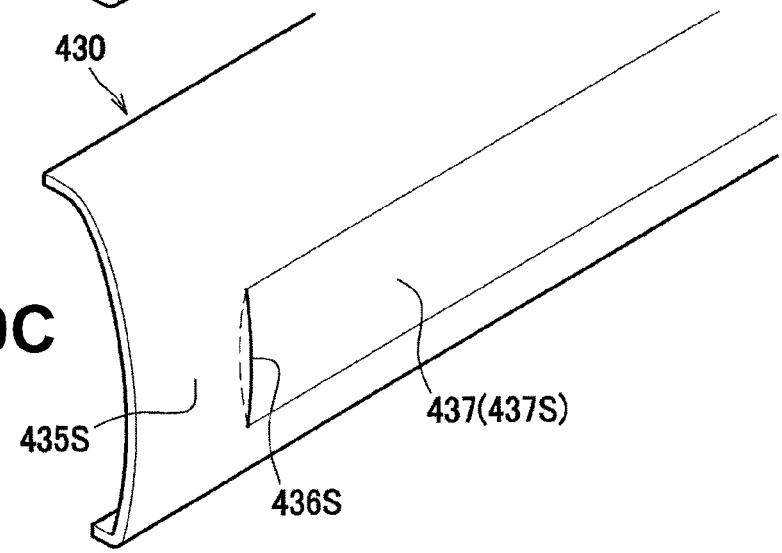

The following will describe modifications in shapes of the first slide contact surface 137S, the second slide contact surface 135S, and the connecting surface 136S described in the first embodiment. FIG. 9A illustrates a nip plate 230 including a second slide contact surface 235S, which is convex or protrudes toward the pressure roller 150, a first slide contact surface 237, which is flat, and a connection surface 236S, which is bow-shaped in cross section or protrudes toward the pressure roller 150. FIG. 9B illustrates a nip plate 330 including first and second slide contact surfaces 337S and 335S, which are concave or recessed toward the halogen lamp 120, and a connecting surface 336S, which is crescent-shaped. The crescent-shaped connecting surface 336S is formed by making a curvature radius of the first slide contact surface 337S greater than that of the second slide contact surface 335S. FIG. 9C illustrates a nip plate 430 including a second slide contact surface 435S, which is convex, and a first slide contact surface 437S, which is concave, and a connecting surface 436S, which protrudes toward the pressure roller 150 and the halogen lamp 120.

Even in the modifications illustrated in FIGS. 9A, 9B, and 9C, in cross section perpendicular to the axis 150A of the pressure roller 150, a curvature radius of each of the second slide contact surfaces 235S, 335S, 435S is greater than the curvature radius PR of the outer surface of the roller body 152 of the pressure roller 150.

In the first and second embodiments and the modifications, in cross section perpendicular to the axis 150A of the pressure roller 150, the curvature radius of each of the second slide contact surfaces 135S, 235S, 335S, 435S is greater than the curvature radius PR of the outer surface of the roller body 152 of the pressure roller 150. This allows the fixing belt 110 to contact the second slide contact surface 135S, 235S, 335S, 435S widely, with little possibility that an undesired gap will be formed between the fixing belt 110 and the second slide contact surface 135S, 235S, 335S, 435S. Thus, movement of lubricant from the second slide contact surface 135S, 235S, 335S, 435S to the edge 110E of the fixing belt 110 in the width direction can be efficiently prevented.

The modification illustrated in FIG. 9A includes the first slide contact surface 237S, which is flat, and a step formed by the second slide contact surface 235S and the connecting surface 263B, but does not include a recessed portion. The modifications illustrated in FIGS. 9B and 9C include recessed portions 337, 437, respectively, within an area in which the nip plate 330, 430 can contact the fixing belt 110, and thus are advantageous in holding grease between each recessed portion 337, 437 and the fixing belt 110.

In each of the first and second embodiments and the modifications, the nip plate 130, 230, 330, 430 includes the second slide contact surface 135S, 235S, 335S, 435S continuing from the connecting surface 136S, 236S, 336S, 436S and extending beyond the imaginary plane P1 and the edge 110E of the fixing belt 110 to the end of the nip plate 130, 230, 330, 430.

The second slide contact surface 135S, 235S, 335S, 435S may not extend over the first imaginary plane P1.

Each of the first and second embodiments and the modifications shows, but is not limited to, the connecting surface 136S, 236S, 336S, 436S extending in the moving direction of the fixing belt 110 relative to the nip NP. For example, the connecting surface may be inclined at an angle of plus or minus 45 degrees relative to the moving direction of the fixing belt 110 (or inward or outward when viewed from the pressure roller 150).

Each of the first and second embodiments and the modifications shows, but is not limited to, the connecting surface 136S, 236S, 336S, 436S as a plane perpendicular to the axis 150A of the pressure roller 150. For example, assuming that the connecting surface has little effect on formation of the nip NP and sliding rotation of the fixing belt, the connecting surface may be inclined relative to a plane perpendicular to the axis 150A of the pressure roller 150 when viewed in the moving direction of the fixing belt 110 or may be flat or curved. Regardless of shape of the connecting surface, as the connecting surface is disposed between the edges 110E of the fixing belt 110 and outside of the maximum image area, grease can be held within the edges 110E of the fixing belt 110 and prevented from leaking outside from the edges 110E of the fixing belt 110.

Figure 10:
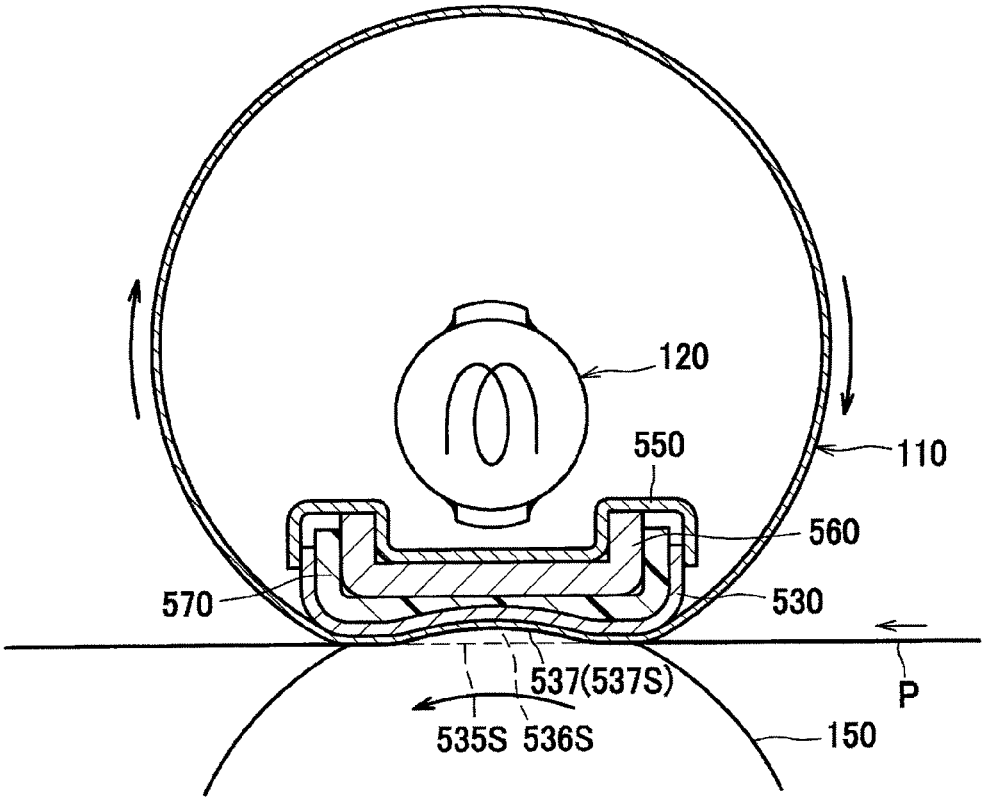
FIG. 10 is a sectional view of a fixing device in a plane perpendicular to a left-right direction according to a modification.

The above embodiment shows, but is not limited to, the fixing device 100 configured to apply heat to the fixing belt 110 via the nip plate 130 by allowing the halogen lamp 120 to heat the nip plate 130. For example, as illustrated in FIG. 10, the fixing device may be configured to apply heat to the fixing belt 110 directly by the halogen lamp 120. In FIG. 10, a nip plate 530 is substantially U-shaped in cross section, and spaced apart from the halogen lamp 120 inside of the fixing belt 110.

The nip plate 530 includes a first slide contact surface 537S configured to contact the inner surface 111 of the fixing belt 110 via grease, a second slide contact surface 535S disposed closer to an edge 110E of the fixing belt and the axis 150A of the pressure roller 150 than the first slide contact surface 537S and configured to contact the inner surface 111 of the fixing belt 110, and a connecting surface 536S connecting the first slide contact surface 537S and the second slide contact surfaces 535S.

The connecting surface 536S is disposed outside of the maximum image area and closer to the center than the edge 110E of the fixing belt 110 (or between the first imaginary plane P1 and the second imaginary plane P2) as in the above embodiments. A reflective member 550, a supporting member 560, and a heat insulator 570 are disposed between the halogen lamp 120 and the nip plate 530.

The reflective member 550 is configured to reflect heat from the halogen lamp 120 toward the fixing belt 110, and the supporting member 560 is configured to support the nip plate 530 and the reflective member 550. The heat insulator 570 is formed of resin, e.g., liquid crystal polymer, and is configured to prevent the heat from the halogen lamp 120 from conducting to the nip plate 530 directly.

The above embodiment shows, but is not limited to, the halogen lamp 120 as an example of a heater. The heater may include a ceramic heater or a carbon heater, for example.

The above embodiment shows, but is not limited to, plate-shaped nip plate 130 as an example of a nip member. The nip member may be thick.

The above embodiment shows, but is not limited to the pressure roller 150 as an example of a backup member. The backup member may include a belt-shaped member.

The above embodiment shows, but is not limited to, the laser printer 1 configured to from a monochrome image on a sheet P as an example of an image forming apparatus including the fixing device to which the disclosure is applied. The image forming apparatus may include a printer configured to form a color image on a sheet P. In addition, the image forming apparatus may include a copier and a multifunction apparatus which are provided with document readers, e.g., flatbed scanners.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A fixing device comprising:

an endless belt extending in a first direction and configured to rotate;

a nip member extending in the first direction and disposed in contact with an inner surface of the endless belt via a lubricant such that the endless belt is slidable on the nip member; and a backup roller extending in the first direction and configured to rotate about an axis and disposed in contact with an outer surface of the endless belt such that the backup roller and the nip member sandwich the endless belt therebetween and the backup roller and the outer surface of the endless belt form a nip therebetween, wherein the nip member has:

a first slide contact surface disposed in contact with the inner surface of the endless belt, the first slide contact surface extends continuously across a center of the nip member in the first direction;

a second slide contact surface disposed in contact with the inner surface of the endless belt and closer to an edge of the inner surface of the endless belt in the first direction than the first slide contact surface and closer to the axis of the backup roller than the first slide contact surface; and a connecting surface connecting the first slide contact surface and the second slide contact surface in the first direction, the connecting surface extending in at least a second direction different from the first direction, wherein a curvature radius of the second slide contact surface of the nip member is greater than a curvature radius of the backup roller in cross section perpendicular to the axis of the backup roller, and wherein the connecting surface of the nip member is disposed between a first imaginary plane and a second imaginary plane, the first imaginary plane including the edge of the endless belt in the first direction and extending perpendicularly to the axis of the backup roller, the second imaginary plane including an end of a maximum image area proximate to the edge of the endless belt in the first direction and extending perpendicularly to the axis of the backup roller.

2. The fixing device according to claim 1, wherein the connecting surface of the nip member is disposed between the second imaginary plane and a third imaginary plane, the third imaginary plane including an end of the nip disposed proximate to the edge of the endless belt in the first direction and extending perpendicularly to the axis of the backup roller.

3. The fixing device according to claim 1, wherein the connecting surface of the nip member is disposed between the first imaginary plane and a third imaginary plane, the third imaginary plane including an end of the nip disposed proximate to the edge of the endless belt in the first direction and extending perpendicularly to the axis of the backup roller.

4. The fixing device according to claim 1, wherein a dimension of the connecting surface of the nip member in a moving direction of the endless belt is smaller than a dimension of the nip in the moving direction of the endless belt, the nip being located in an area disposed between the first imaginary plane and the second imaginary plane.

5. The fixing device according to claim 1, wherein a dimension of the connecting surface of the nip member in a moving direction of the endless belt is greater than a dimension of the nip in the moving direction of the endless belt, the nip being located in an area disposed between the first imaginary plane and the second imaginary plane.

6. The fixing device according to claim 1, wherein the nip member has a recessed portion recessed in a direction away from the axis of the backup roller, the recessed portion being partially defined by the connecting surface of the nip member.

7. The fixing device according to claim 1, wherein the nip member includes a metal plate, and wherein the connecting surface of the nip member includes a first bend portion coupled to the first slide contact surface and a second bend portion coupled to the second slide contact surface.

8. The fixing device according to claim 1, wherein a dimension of the connecting surface of the nip member in a direction perpendicular to both the axis of the backup roller and a moving direction of the endless belt is 0.1 mm to 1.0 mm.

9. The fixing device according to claim 1, wherein the connecting surface of the nip member extends along a moving direction of the endless belt in the nip.

10. The fixing device according to claim 1, wherein the second slide contact surface of the nip member continues from the connecting surface and extends beyond the first imaginary plane to an outside of the endless belt in a direction opposite to the connecting surface.

11. The fixing device according to claim 10, wherein the second slide contact surface of the nip member extends to an edge of the nip member in the direction opposite to the connecting surface.

12. The fixing device according to claim 1, wherein a dimension of the second slide contact surface in a direction of the axis of the backup roller is 1.0 mm to 5.0 mm.

13. The fixing device according to claim 1, wherein a dimension of the connecting surface in a moving direction of the endless belt is 5.0 mm to 15 mm.

14. The fixing device according to claim 4, wherein a dimension of the second slide contact surface in the moving direction of the endless belt is greater than the dimension of the connecting surface in the moving direction of the endless belt.

15. The fixing device according to claim 14, wherein the dimension of the second slide contact surface in the moving direction of the endless belt is 5.0 mm to 20 mm.

16. The fixing device according to claim 1, wherein the connecting surface is inclined at an angle having a range from plus 45 degrees to minus 45 degrees relative to a moving direction of the endless belt.

17. The fixing device of claim 1, wherein the second direction is perpendicular to the first direction.

18. A fixing device comprising:

an endless belt extending in a first direction;

a nip member extending in the first direction and disposed in contact with an inner surface of the endless belt via a lubricant such that the endless belt is slidable on the nip member; and a backup member extending in the first direction and disposed in contact with an outer surface of the endless belt such that the backup member and the nip member sandwich the endless belt therebetween and the backup member and the outer surface of the endless belt form a nip therebetween, wherein the nip member includes a recessed portion recessed in a direction away from the backup member, the recessed portion extending continuously across a center of the nip member in the first direction, wherein an end of the recessed portion of the nip member in the first direction is disposed between a first imaginary plane and a second imaginary plane, the first imaginary plane including an edge of the endless belt in the first direction and extending perpendicularly to an axis of the backup member, the second imaginary plane including an end of a maximum image area proximate to the edge of the endless belt in the first direction and extending perpendicularly to the axis of the backup member.

19. A fixing device comprising:

an endless belt extending in a first direction and configured to rotate;

a nip member extending in the first direction and disposed in contact with an inner surface of the endless belt via a lubricant such that the endless belt is slidable on the nip member; and a backup roller extending in the first direction and configured to rotate about an axis and disposed in contact with an outer surface of the endless belt such that the backup roller and the nip member sandwich the endless belt therebetween and the backup roller and the outer surface of the endless belt form a nip therebetween, wherein the nip member includes a recessed portion recessed in a direction away from the backup roller, wherein a first end of the recessed portion in the first direction is disposed closer to a center of the nip member than a first edge of the endless belt in the first direction, wherein a second end of the recessed portion in the first direction is disposed closer to the center of the nip member than a second edge of the endless belt in the first direction, wherein a first end of the backup roller in the first direction is disposed between the first end of the recessed portion and the first edge of the endless belt, and wherein a second end of the backup roller in the first direction is disposed between the second end of the recessed portion and the second edge of the endless belt.

* * * * *